US009142114B2

(12) United States Patent
Ramachandran

(10) Patent No.: US 9,142,114 B2
(45) Date of Patent: Sep. 22, 2015

(54) TRACKING GROUP MEMBERS' PROXIMITY

(71) Applicant: Apple Inc., Cupertino, CA (US)

(72) Inventor: Prashanth Ramachandran, Foster City, CA (US)

(73) Assignee: Apple Inc., Cupertino, CA (US)

( * ) Notice: Subject to any disclaimer, the term of this patent is extended or adjusted under 35 U.S.C. 154(b) by 100 days.

(21) Appl. No.: 13/752,144

(22) Filed: Jan. 28, 2013

(65) Prior Publication Data

US 2014/0210616 A1 Jul. 31, 2014

(51) Int. Cl.
*G08B 1/08* (2006.01)
*G08B 21/02* (2006.01)

(52) U.S. Cl.
CPC ..... *G08B 21/0227* (2013.01); *G08B 21/0263* (2013.01); *G08B 21/0266* (2013.01); *G08B 21/0294* (2013.01); *G08B 21/0236* (2013.01)

(58) Field of Classification Search
CPC ..... G08B 21/18; G08B 21/0202; G08B 13/1427; G08B 21/0227; G08B 21/0294; G08B 21/0263; G08B 21/0266; G08B 21/0236; G01C 21/26; G01C 21/20
USPC ..... 340/539.13, 539.15, 539.21, 539.1, 340/539.2, 539.23, 573.1, 573.4, 10.1
See application file for complete search history.

(56) References Cited

U.S. PATENT DOCUMENTS

| | | | | |
|---|---|---|---|---|
| 6,563,427 | B2 * | 5/2003 | Bero et al. | 340/573.1 |
| 6,847,295 | B1 * | 1/2005 | Taliaferro et al. | 340/539.13 |
| 7,323,991 | B1 | 1/2008 | Eckert et al. | |
| 7,609,159 | B2 | 10/2009 | Benson et al. | |
| 7,741,968 | B1 * | 6/2010 | Tannenbaum et al. | 340/539.13 |
| 8,159,339 | B2 | 4/2012 | McCrone | |
| 8,164,443 | B2 | 4/2012 | Alston et al. | |
| 2004/0150520 | A1 * | 8/2004 | Barrie | 340/539.13 |
| 2007/0040671 | A1 * | 2/2007 | Medve et al. | 340/539.15 |
| 2007/0262862 | A1 * | 11/2007 | Barrett et al. | 340/539.15 |
| 2012/0071129 | A1 * | 3/2012 | Haney | 455/404.2 |

* cited by examiner

*Primary Examiner* — Anh V La
(74) *Attorney, Agent, or Firm* — Fish & Richardson P.C.

(57) ABSTRACT

Methods, systems, and apparatus, including computer programs encoded on a computer storage medium, for tracking group members' proximity include associating a plurality of sensors with an application installed on each of a plurality of user devices and assigning each of the sensors to a corresponding one of the user devices. Assignments received on one of the user devices are wirelessly communicated to at least one other of the user devices, and proximity of each of the sensors to the corresponding user device is monitored. Status information is communicated between two or more of the user devices, and the status information indicates proximity of sensors to the corresponding user device and/or sensor assignments.

26 Claims, 11 Drawing Sheets

TRACKING GROUP MEMBERS' PROXIMITY

BACKGROUND

This specification relates to monitoring proximity for tracking members of a group.

In crowded locations, particularly in locations with distractions (e.g., shopping malls or museums) families, tourist groups, or other groups can have difficulty maintaining contact with one another or keeping track of where others in the group are located. Communication by mobile phone is one option for staying in contact, but not everyone in the group necessarily has a mobile phone, particularly if some members of the group are young or otherwise require closer monitoring. Systems exist for monitoring location of objects using, for example, radio frequency identification (RFID) techniques, such as in the shipping industry or for purposes of determining whether an object leaves a defined perimeter, but such systems are generally not conducive to monitoring people particularly in large or public areas and require significant infrastructure support.

SUMMARY

Implementations of the present disclosure are generally directed to tracking group member proximity. The leader of a tourist group may need to monitor proximity of the group members when the tourist group includes young children, foreigners, disabled persons, or individuals that may wander astray and have difficulties rejoining the group. The present disclosure describes methods, devices, and systems for the leader to monitor the proximity of group members with regular updates. For example, the group can be divided in to sub-groups with a group leader overseeing sub-group leaders, who in turn have primary responsibility for monitoring individual subgroup members. The proximity sensors may be attached to each of the sub-group members in forms of bracelets, headbands, pins, tags, etc. The proximity sensors are configured to transmit signals to a user device of the corresponding sub-group leader. The user device can determine at least the distance between the proximity sensors and the user device based on the received signal strength, and/or other signal characteristics or types of signals (e.g., signals that include location coordinates). If the distance exceeds a predefined threshold value, an alarm can be triggered on the sub-group leader's user device and a warning signal can be sent to the overall group leader.

In one general aspect, a method for tracking members of a group includes associating a plurality of sensors with an application installed on each of a plurality of user devices; assigning each of the sensors to a corresponding one of the user devices, wherein assignments received on one of the user devices are wirelessly communicated to at least one other of the user devices; monitoring proximity of each of the sensors to the corresponding user device; and communicating status information between two or more of the user devices, wherein the status information indicates at least one of proximity of sensors to the corresponding user device or sensor assignments. Additional aspects can be implemented in corresponding apparatus, systems, and computer software stored on a computer readable storage device and executable on one or more computers.

These and other embodiments can each optionally include one or more of the following features. One of the plurality of user devices is assigned as a master user device, the master user device receives updates regarding at least one of proximity between a sensor and the corresponding user device or sensor assignments, and the updates are received from other user devices having corresponding assigned sensors. A map of at least an approximate location of the plurality of user devices and the plurality of sensors is displayed. Alarm parameters associated with the plurality of sensors are assigned. The alarm parameters are communicated between two or more of the user devices. The alarm parameters associated with a first sensor of the plurality of sensors differ from the alarm parameters associated with a second sensor for the plurality of sensors. An alarm on a user device corresponding to a first sensor of the plurality of sensors is triggered based on an alarm condition satisfying the alarm parameters associated with the first sensor. Status information regarding the alarm condition is communicated to at least one other of the plurality of user devices. A user interface is provided on one of the plurality of user devices that enables a reassignment of a first sensor from a first user device to a second user device, and a proximity of the first sensor to the second user device is monitored after the reassignment. The sensors communicate with the corresponding user device via a short range wireless communication link. A direction between one or more of the plurality of user devices and a first sensor of the plurality of sensors is detected and an indication of the direction between a first user device and the first sensor is displayed on the first user device.

In another general aspect, a method includes providing a display identifying a plurality of sensors adapted to be monitored on with an application installed on each of a plurality of user devices; receiving, through a user interface, an assignment of each of the sensors to a corresponding one of the user devices; communicating the assignments to at least one other of the user devices; receiving status information regarding a proximity of each of the sensors to the corresponding user device; and displaying an indication of proximity of at least one of the sensors and the corresponding user device. Additional aspects can be implemented in corresponding apparatus, systems, and computer software stored on a computer readable storage device and executable on one or more computers.

These and other embodiments can each optionally include one or more of the following features. An assignment of a monitoring status of the user devices is received through the user interface. A map of at least an approximate location of the user devices and the corresponding sensors is displayed on a user interface. An assignment of alarm parameters associated with the plurality of sensors is received through the user interface. An indication of an alarm condition from one of the plurality of user devices is received and information relating to the alarm condition is displayed. Location information for a first sensor of the plurality of sensors is received, and at least an approximate direction toward the first sensor is displayed.

In another general aspect, a system includes a plurality of sensors and a plurality of user devices adapted to communicate wirelessly with the plurality of sensors. Each user device includes software instructions adapted, when executed by processing apparatus on the user device, to display an assignment of sensors to a corresponding user device of the plurality of user devices; monitor proximity of sensors to at least one user device; and communicate status information with at least one other of the user devices, wherein the status information includes a proximity of sensors to the corresponding user device and an identification of sensor assignments to the corresponding user device.

These and other embodiments can each optionally include one or more of the following features. The sensors communicate with the user devices using a short range wireless transmission. Software instructions on at least a master user device are adapted, when executed by processing apparatus on the user device, to receive assignments of the sensors to the corresponding user device through a user interface, to receive alarm parameters associated with each sensor through a user interface and to communicate the alarm parameters to the user device corresponding to the sensor, and/or to display status information associated with each of the user devices having corresponding sensor assignments.

Particular embodiments of the subject matter described in this specification can be implemented so as to realize one or more of the following advantages. The disclosed group members' proximity tracking methods and systems can let group leaders be continuously updated with proximity information with other sub-group leaders and their members. The group leaders can monitor proximity of members in a comprehensive yet structured manner for efficiency. A master group leader can designate sub-group leaders who can monitor multiple members' proximity. The proximity information of sub-groups is reported to the master group leader by active communication among user devices. The proximity information can be collected and determined by assigning proximity sensors in forms of easy-to-carry and secure forms, such as bands, pins, and tags. The proximity sensors can transmit signals and/or location coordinates to the user devices carried by sub-group leaders and the master group leader. Alarm settings for each proximity sensor may be efficiently carried out by a priority setting. For example, a high priority setting corresponds to a low pre-defined permitted activity radius, and vise-versa.

The details of one or more embodiments of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Implementations of the present disclosure are directed to systems and methods of tracking proximity of members of a group. In general, monitoring of members of a group can be accomplished using sensors embedded in a wristband or necklace or other devices that can be easily distributed to members of a group. The sensor can communicate with user devices (e.g., smart phones or other portable devices) that include an installed software application for use in communicating information regarding the sensors and/or proximity of the sensors to the user devices. A master device, which may be self-appointed, for example, can execute the installed software application to exchange information for facilitating monitoring with other user devices that also include the installed software application. The exchanged information can include, for example, whether the user device is available for assignment of corresponding sensors, information about monitoring parameters, location, proximity of sensors, and assignment of primary responsibility for monitoring specific sensors.

The master device can assign sensors to be monitored by each user device. Each of the sensors can communicate with the user devices (e.g., devices that are within range) by transmitting signals that are detected by the receiving user device. In this manner, at least the user device with primary responsibility for monitoring each sensor can detect approximate proximity (e.g., distance) based on signal strength or other information (e.g., coordinates determined through a satellite or terrestrial-based locating system) through which distance from the user device can be determined. Each sensor can further include monitoring parameters that can be used to determine when to trigger an alert or alarm on the user device and/or on other user devices. In some implementations, the alert can include a quick contact list based on relevance. For example, as an alternative or in addition to dialing "911," the alert can prompt other emergency services including a visitor center contact. Such emergency services can be contacted via an Internet information service. Sensors can also be dynamically reassigned to a new or different user device by the master user device or by other user devices. The proximity information and sensor assignment information can be communicated to the master device and/or between the other user devices.

Figure 1:
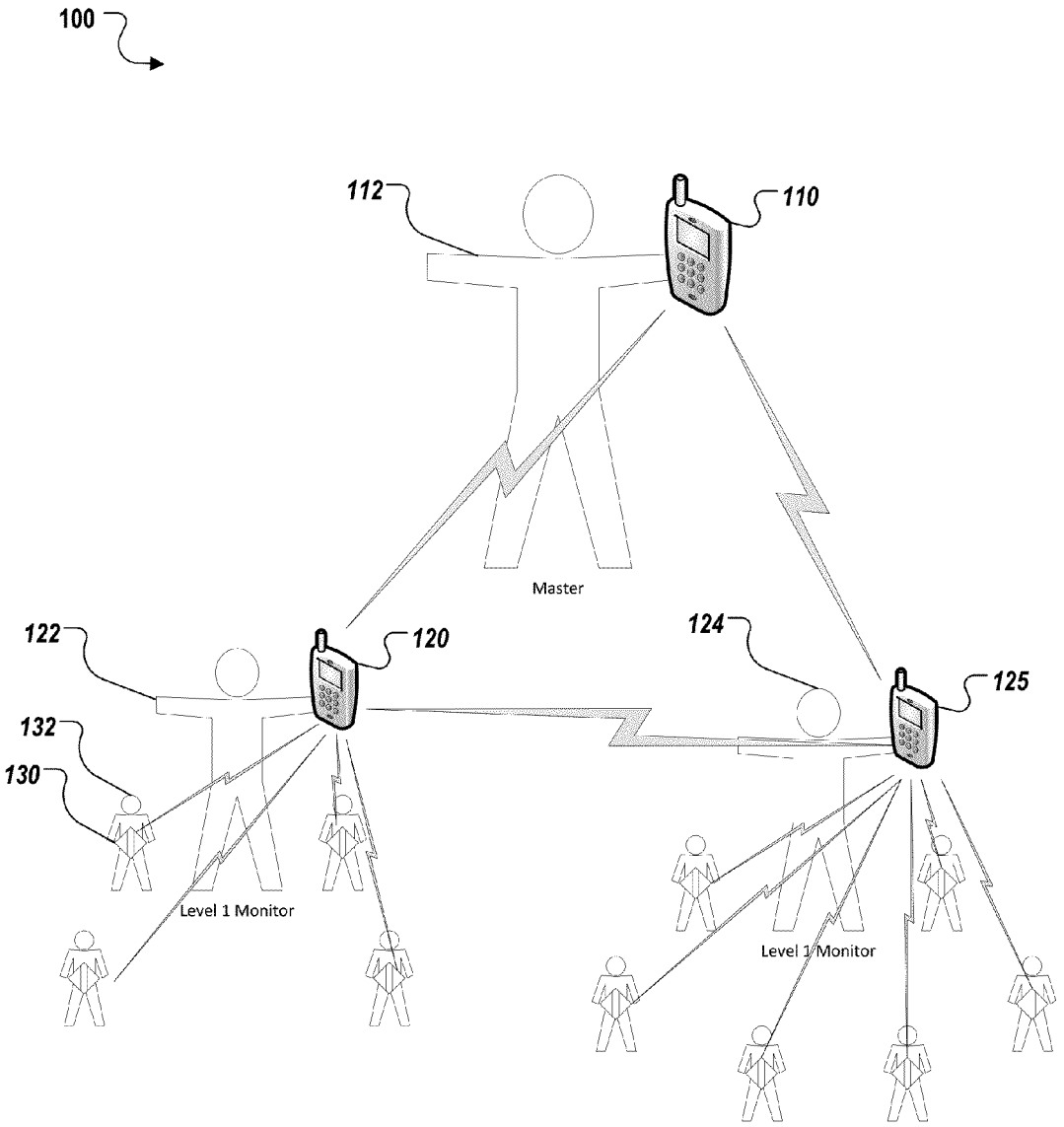
FIG. 1 is an illustration of a system configuration for tracking group members' proximity to one another.

FIG. 1 is an illustration of a system configuration 100 for tracking group members' proximity to one another. The system configuration 100 includes a group of members of different hierarchy levels. For example, the illustrated group includes three leaders 112, 122, and 124, and multiple children 132. The group can be divided into two sub-groups: the leader 122 leading a first sub-group of four children 132, and the leader 124 leading a second sub-group of six children 130. The two sub-groups and their respective leaders can be monitored by the master group leader 112. The three leaders 112, 122, and 124 may each have a smart cellular phone or any suitable user device for communication and tracking group members' proximity. For example, the smart phone 110 of the master group leader 112 can communicate with the smart phone 120 of the first sub-group leader 122, and the smart phone 125 of the second sub-group leader 124. The smart phones 120 and 125 can also communicate with each other. Each of the multiple children 132 has a proximity sensor 130 (e.g., in forms of secure attachments, such as bracelets, headbands, pins, or tags). The proximity sensor 130 can transmit signals that can be received by one or more of the smart phones. For example, the proximity sensors 130 of the first sub-group can send signals to the smart phone 120 of the sub-group leader 122 when the proximity sensor 130 is in range of the smart phone 120. Thus, each of the sub-group leaders 122 or 125 receives corresponding signals from the proximity sensors 130 on the smart phones 120 or 125. The smart phones 120 and 125 can determine the distance of the proximity sensors 130 based on signal strength or other information carried in the signals (e.g., location coordinates determined at the proximity sensors 130 using GPS or other satellite or terrestrial-based position locating technologies). The received signal is used to generate monitoring reports respectively viewable to the sub-group leaders 122 and 124. The monitor reports, or some of the data in the reports, can be sent to the smart phone 110 of the master group leader 112, where the monitor reports can be further combined and displayed to the master group leader 112 on the smart phone 110. For example, an overall status of all sub-group leaders and members can be displayed on the smart phone 110.

The smart phones 110, 120, and 125 can use an installed software application that processes the received proximity sensor signals (e.g., to detect an identifier of each sensor 130). The application also provides an interactive graphical user interface (GUI) for the master group leader 112 and the sub-group leaders 120 and 125 to display information based on the signals received from the proximity sensors 130. For example, the application GUI allows the sub-group leaders 122 and 124 or the master group leader 112 to assign sensors 130 to particular children 132 and/or to each of the sub-groups. The master group leader 112 can assign children 132 to the sub-group leaders 122 and 124; and the sub-group leaders 122 and 124 may reassign one or more of the children 132 to other sub-groups. In some instances, the application can automatically detect the proximity sensors 130 in range and assign by default based on a pre-defined distance threshold (e.g., children 132 within the threshold are assigned to the corresponding sub-group leader). The sub-group leaders 122 and 124 can configure, through the software application, a constant update about the assigned children status (e.g., whether the proximity sensors 130 are within the pre-defined range). When a proximity sensor 130 is out of the pre-defined range, a warning and/or an alarm can be triggered on the smart phones of the corresponding sub-group leader 122 as well as the master group leader 112.

The smart phones 120 and 125 of the sub-group leaders 122 and 124 actively communicate with each other to provide a comprehensive status to the smart phone 110. In some implementations, the smart phones can receive signals from the proximity sensors 130 to identify a direction of proximity sensors 130, particularly proximity sensors 130 that have triggered an alarm condition. For example, the proximity sensors 130 may include transceivers that can detect signals from each other for use in identifying the distance between the proximity sensors 130. The signal strengths or identified distances can be sent to the corresponding sub-group leader's smart phone or to other smart phones (along with the sensor signals detected by the smart phones) for determining respective directions to the proximity sensor 130 using triangulation. In some cases, the direction may be inferred from a last known position (e.g., if signals from the sensor are no longer being detected). The sub-group leader's smart phone can further relay the direction information to the master group leader and other sub-group leaders. Other techniques for determining, inferring, or predicting direction of a sensor from one or more of the smart phones can also be used. Details of the configuration and operation of the tracking system is described below.

Figure 2:
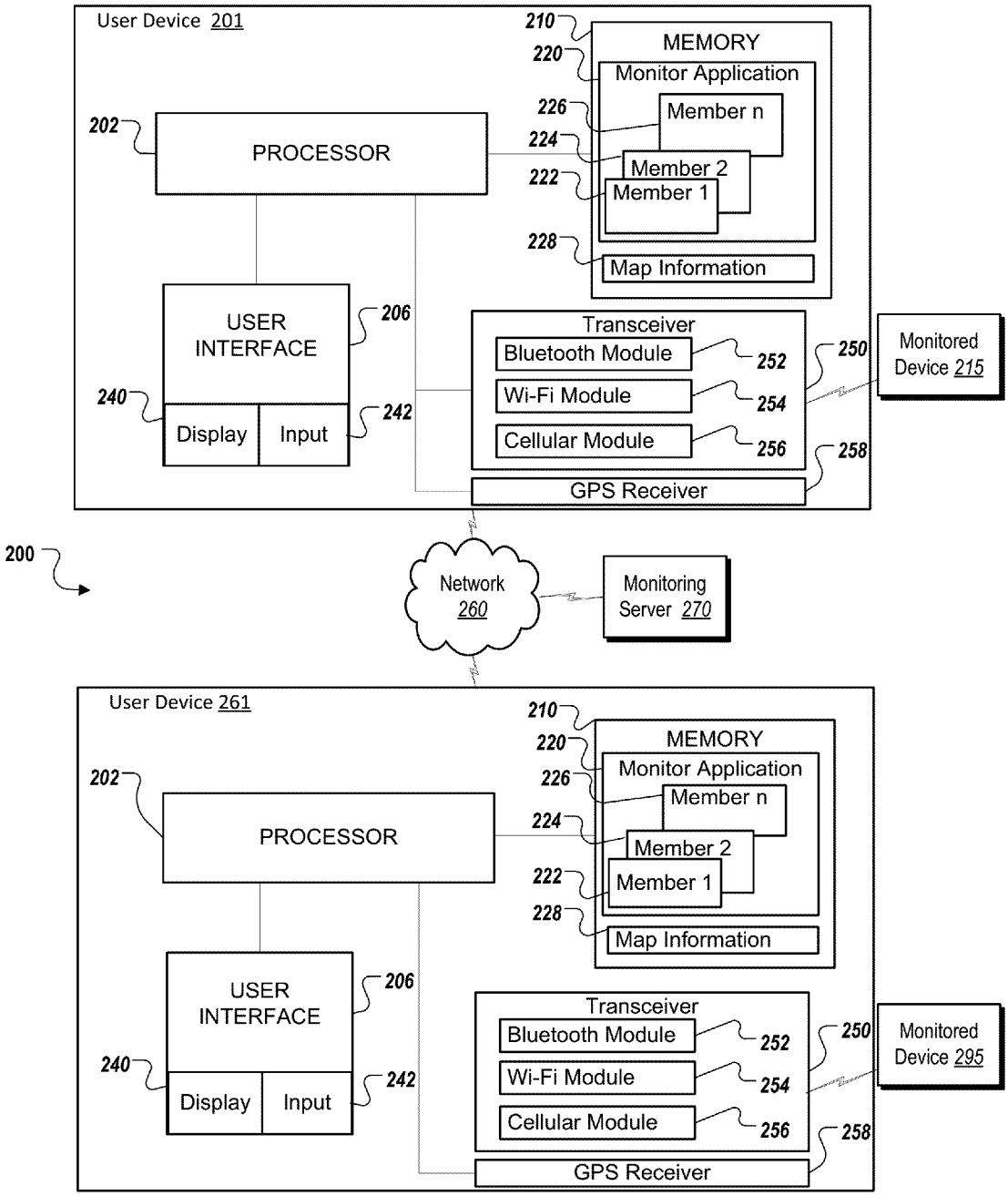
FIG. 2 is a functional block diagram of an example system for tracking group members' proximity.

FIG. 2 is a functional block diagram of an example system 200 for tracking group members' proximity. The system 200 includes a first user device 201, a second user device 261, and a monitoring server 270 communicably connected across a network 260. Each of the user devices may be used by the master group leader 112 or the sub-group leaders 122 and 124 illustrated in FIG. 1. Although FIG. 2 illustrates two user devices 201 and 261, more or less user devices may be included (e.g., only one user device 201, or one or more additional user devices can be included). As illustrated, the user devices 201 and 261 are similar. The following functional and structural description of the user device 201 can be applied to the user device 261.

At a high level, the user device 201 is an electronic computing device operable to receive, transmit, process, store, and/or manage data and information. Generally, the user device 201 can be a smart cellular phone that enables users to install various software applications to utilize various portions of the device hardware, such as the processor 202, the memory 210, the transceiver 250, the user interface 206, and other onboard sensors and devices (e.g., accelerometer, speaker, microphone, etc.). The user device 201 can be associated with one or more monitored devices (sensors) 215. The monitored devices 215 can include various signal generating sensors that allow the user device 201 to determine the distance between the monitored device 215 and the user device 201. For example, the user device 201 may determine the distance based on the strength of the signal sent from the monitored device 215. In some implementations, the monitored device 215 may send location coordinates (e.g., determined by onboard GPS receiver) to the user device 201. The user device 201 can use the distance information in a software application to inform users (e.g., the master group leader or sub-group leaders) about proximity status of the monitored devices 215. In some implementations, the distance information, as well as other tracking data used in the software application, may be sent to the monitor server 270 across the network 260 (described below).

The user device 201 includes a processor 202. Although illustrated as a single processor 202 in FIG. 1, two or more processors may be used according to particular design requirements or particular implementations of the system 200. Generally, the processor 202 executes instructions and manipulates data to perform the operations of the user device 201. Specifically, the processor 202 executes the functionality of the operation system and installed software applications on the user device 201.

The user device 201 also includes a memory 210 that holds application files and data for the user device 201. For example, the memory 210 includes a monitor application 220 for use in communicating information between the monitored device 215 (e.g., sensors therein) and the user device 201. The monitor application 220 may be downloaded from an application server and installed and/or updated on the user device 201. The monitor application 220 can allow a user to input and store information about one or more members (e.g., members 222, 224, and 226) that are associated with one or more monitor devices 215. The member data may include identification, group/leader information, monitoring update interval, allowable radius, surrogate leader/master leader, and other parameters and information for monitoring. At least some of the member data can be set by default in the monitor application, and/or can be defined and modified by a user (e.g., master leader and sub-group leader). Although illustrated as a single memory 210, two or more memories may be used according to particular implementations of the system 200. While memory 210 is illustrated as an integral component of the user device 201, in alternative implementations, memory 210 can be external to the user device 201 (e.g., using memory accessible across the network 260) and/or the system 200.

The monitor application 220 can actively identify the monitored device(s) 215 in range of the user device 201. For example, when users initiate the monitor application 220, the user device 201 performs a search for the monitored devices 215. The search may be based on a signal strength threshold by default. A user may also define a signal strength threshold for the search. The monitor application 220 displays the identified monitored devices 215 to the user on the user interface 206. The user can thus provide further commands and configurations for the monitored devices 215. The monitor application 220 also provides options for assigning monitor devices 215 among multiple user devices. For example, the user can assign a monitored device 215 to another user device (e.g., the user device 261). The monitor application 220 enables multiple user devices to communicate monitoring information using communication capabilities of the user device 201. The communication can provide a comprehensive status of available monitored devices 215, e.g., when some monitored devices 215 are not in range of all of the multiple user devices. For example, some monitored devices 215 or 295 may be in range of the user device 201 and not in range of the user device 261. The user device 261 can thus communicate with the user device 201 to obtain information on the monitored devices 215 or 295.

The memory 210 can also include map information 228 of an approximate location of the monitored devices 215. The map information 228 can include map data of the current location of the user device 201. For example, the location coordinates of the user device 201 may be determined using the GPS receiver 258. The user device 201 may be connected to a map database across the network 260 and download map data near the current location. The map data may include point of interests, building information, address information, phone numbers, etc. The relative position of the monitored devices 215 can thus be placed in a geographical context provided by the map information 228.

The user device 201 includes a user interface 206. The user interface 206 enables users to interact with the user device 201. The user interface 206 further includes a display component 204 and an input component 242. For example, the display component 204 functions to enable users to have visual access to the monitor application 220. The display component 240 can include a liquid crystal display (LCD) back lit by fluorescent light panels or light emitting diode (LED) panels. The display component 240 can also include a projector, cathode ray tube, or other display devices. The input component 242 can include various input devices such as a trackpad, a multi-touch panel, a mouse, a keyboard, and light sensors, among others. In some implementations, the display component 240 and the input component 242 can together be a touchscreen (e.g., an LCD display behind a transparent touch sensitive panel). Although the display component 240 and the input component 242 are illustrated as separate components/elements, they can be combined or integrated as a single component having functions for display and input.

The user device 201 further includes a transceiver 250. The transceiver 250 enables the user device 201 to connect with the network 260 for communicating with other user devices and servers, such as the user device 261 and the monitoring server 270. The transceiver 250 can transmit and receive wireless data signals to and from the network 260. The transceiver 250 can include multiple modules based on different communication technologies, for example, the transceiver 250 includes a Bluetooth module 252, a wi-fi module 254, and a cellular module 256. These modules enable the user device 201 join networks based on each corresponding technologies. For example, Bluetooth module 252 may be used for local network communications and for low energy consumption. Wi-fi module 254 and/or cellular module 256 may be used, if available, to communicate with remote servers and with other user devices. Other types of modules can also be implemented to facilitate communications using other technologies supported by the network 260.

A GPS receiver 258 can be implemented in the user device 201 to provide geo-location information to the monitor application 220. For example, the monitor application 220 can use the geo-location information to provide users of other connected user devices about the distances and relative positions. In some implementations, the transceiver 250 may use network signal triangulation to provide verification of geo-location information. When GPS receiver 258 fails to receive GPS signals (e.g., in a building or a covered structure blocking satellite signals), the transceiver 250 may provide primary geo-location information.

The monitored devices 215 can include signal transmitters embedded in attachable items, such as bracelets, headbands, pins, and sticky tags. The signal transmitters can continuously or periodically transmit wireless signals of low energy consumption. The wireless signals can include an identifier of the respective monitored device 215 and are used by the user device 201 to determine the distance of the monitored devices 215 from the user device 201. For example, the distance determination can be based on evaluating the signal strength detected at the user device 201 (e.g., the closer the monitored device 215 to the user device 201, the stronger the signal). In some implementations, the monitored devices 215 can include other sensors to receive location coordinate information. For example, the monitored devices 215 may include a GPS receiver used to determine location coordinates, and can transmit the coordinate information to the user device 201. In addition to providing data for determining the distance or providing coordinates of the monitored devices 215, each of the monitored devices 215 may detect signals from or determine the distances from other monitored devices 215. The distance information between the monitored devices 215 can then be used at the user device 201 to determine the relative direction or position of each of the monitored devices 215 using triangulation. Details of the monitored devices 215 are described in FIGS. 3A to 3G.

The monitoring server 270 can communicate with the user device 201, the user device 261, and/or other additional user devices and can store. A master group leader may have access to the monitoring server 270 or the server functionality may be implemented in the user device of the master group leader. The monitoring server 270 can also be replicated on other user devices to provide redundant capabilities. If any monitored device 215 triggers an alarm, the master group leader can receive a comprehensive status report on both the user device 201 using information stored and provided by the monitoring server 270. In some implementations, the monitoring server 270 can include advanced software applications to generate a detailed status report, and/or to relay the alarm and report to a third party (e.g., security, police department, etc.). In some cases, the monitoring server 270 may have advantages in processing power and network connection capacity to enable the master group leader to be more effective and efficient in monitoring.

The network 260 can include any suitable wireless communication infrastructure providing an ability to communicate between devices and with servers or other computers. The network 260 may also include multiple networks that rely on different communication technologies. Connection to the network 260 can be wireless or wireline (e.g., wireline connection provided for servers or the like). In the illustrated system 200, the network 260 enables user devices 201 and 261 to communicate using the transceivers within the devices. The network 260 can support communications based on various technologies, such as using cellular signals, wi-fi signals, Bluetooth, or the like. Examples of communication networks include a local area network (LAN), a radio access network (RAN), a metropolitan area network (MAN), a wide area network (WAN), Worldwide Interoperability for Microwave Access (WIMAX), a wireless local area network (WLAN) using, for example, 802.11 a/b/g/n and/or 802.20, all or a portion of the Internet, and/or any other communication system or systems at one or more locations. The network may communicate with, for example, Internet Protocol (IP) packets, Frame Relay frames, Asynchronous Transfer Mode (ATM) cells, voice, video, data, and/or other suitable information between network addresses.

Figure 3A:
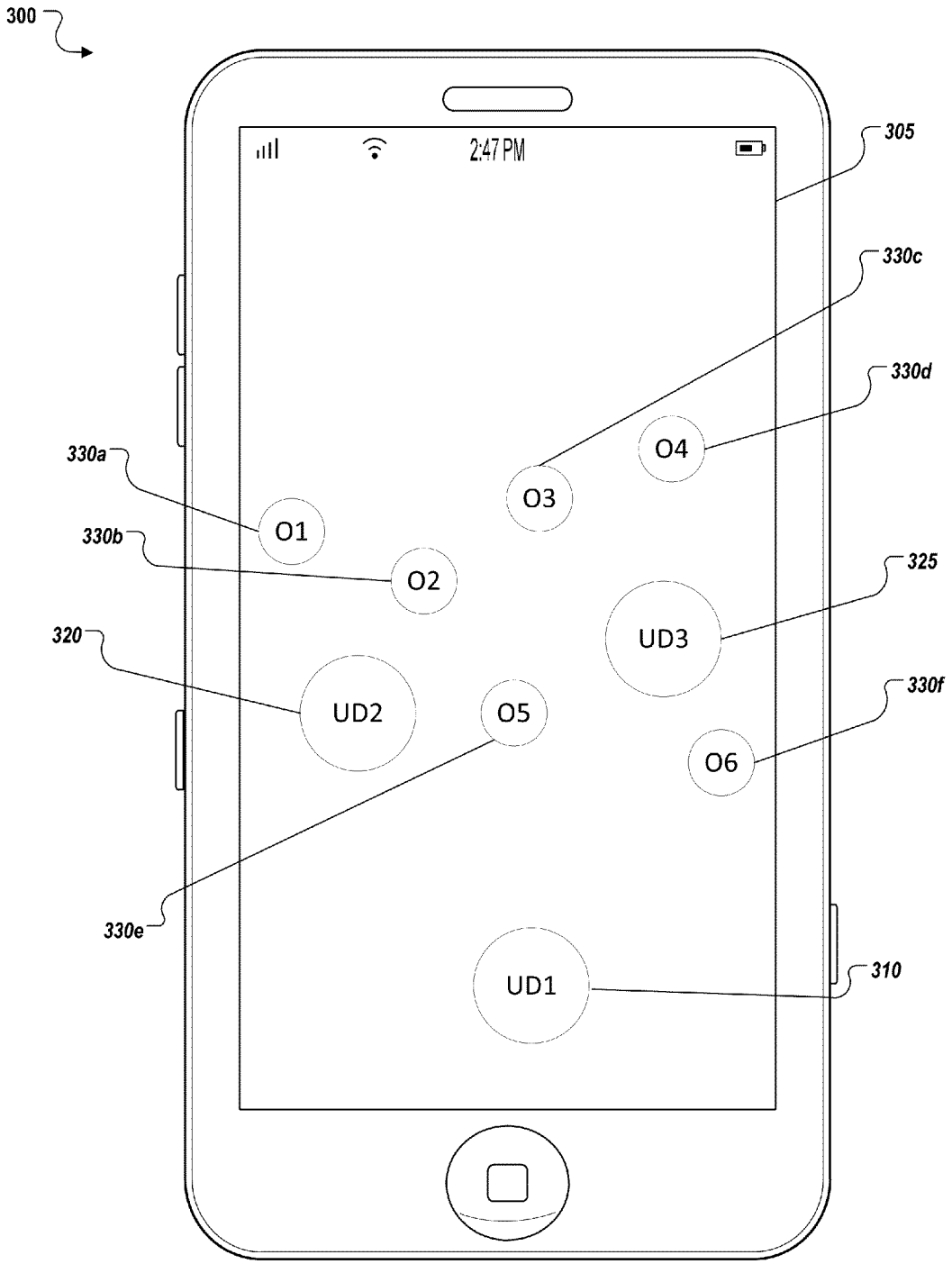
FIGS. 3A to 3G are example user interface displays on a user device reflecting usage instances for tracking proximity of group member.

FIGS. 3A to 3F are example user interfaces on a user device 300 reflecting usage instances for tracking proximity of group members. The user device 300 can be an implementation of the user device 201 of the system 200 in FIG. 2. For example, the illustrated user device 300 is a smart cellular phone with a multi-touch touchscreen 305. The user device 300 is connected to a cellular network and a wi-fi network. The user device 300 can further include a GPS receiver, Bluetooth transceivers, and other components as described in the user device 201. As shown in FIG. 3A, the illustrated usage instance represents a GUI for identifying detectable group leaders and members. Each group leader is associated with a user device (UD), and each member is assigned an observed unit (O). The touchscreen 305 displays information about the connected user devices (310, 320, and 325) and observed units (330 *a-f*). For example, when a user (e.g., a leader using the device 300) initiates a monitor application, the user device 300 seeks connectable user devices and observed units in receivable range (e.g., user devices can be connected through large area network such as cellular or wi-fi networks and/or through short-range networks such as Bluetooth; and observed units can be connected through short-range networks or other local networks). The touchscreen 305 displays the connected user devices and observed units and their relative approximate distance and/or position on a map. For example, the map can be determined and loaded on the user device 300 by determining a location coordinate of the user device using GPS receivers and retrieving map information for an area around the location coordinate from a map server through a network. Alternatively, the map can be retrieved from a server on a local network at the location, or the map can simply illustrate some degree of relative positions (e.g., the map can represent distance between the observed units and the user devices with or without illustrating actual positions).

In the usage instance illustrated in FIG. 3A, three user devices are detected. UD1 310 can be the user device 300 by default. UD2 320 and UD3 325 are other user devices communicable with UD1 310 across a network, similar to the user device 261 in FIG. 2. For example, UD2 320 and UD3 325 can be smart phones with a similar installed monitor application that enables communication of information used by the application among the user devices. In some implementations, the connected user devices can communicate and/or determined detailed geographic information regarding each other, including location coordinates, relative distances, and/or relative or actual speeds. The communication among user devices can be continuous, or intermittent at a pre-defined sampling rate. The user devices can further detect and/or connect with observed units that are in range. For example, observed units can be associated with or assigned to user devices if their signal strength is higher than a threshold value, indicating an in-range proximity.

Figure 3B:
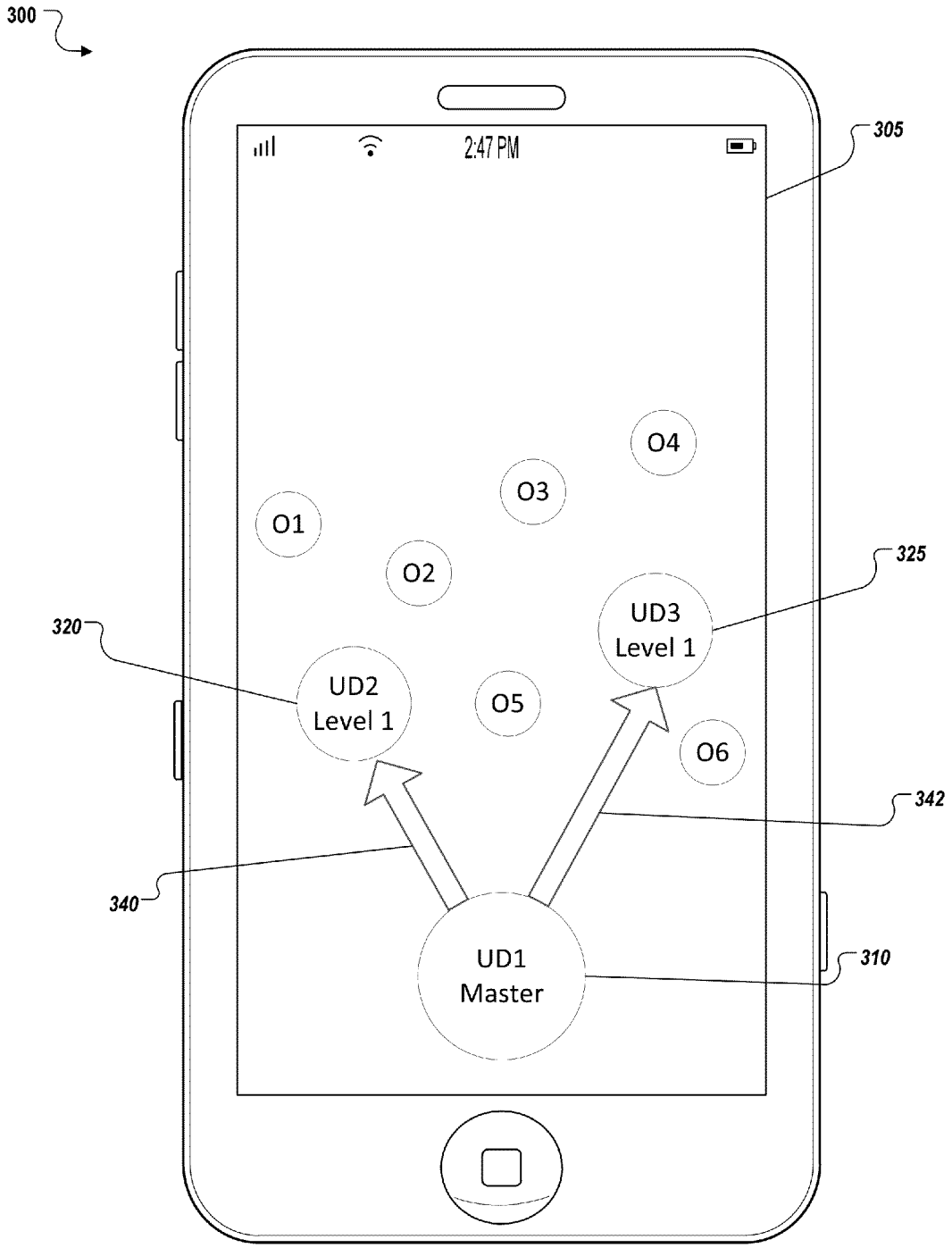

After user devices and observed units are detected, a hierarchy structure can be assigned to indicate leaders, members, and the relationship between leaders and monitored members. In FIG. 3B, a user may first identify leader hierarchy of the user devices. For example, the user may press and hold the UD1 310 on the touchscreen to indicate the UD1 310 is assigned with a master group leader role. The assignment can allow the user device communicate with other user devices to assemble information of the connected observed units. For example, UD1 310 may not be associated with any particular observed units, and may retrieve location information of the observed units from sub-group leader user devices. In some implementations, the sub-group leader user devices can be assigned using a set of multi-touch gestures. For example, after UD1 310 is pressed and held to be assigned as a master group leader device, then a dual touch and/or pinch motion can be used to assign another user device (e.g., UD2 320) as a sub-group leader with respect to UD1 310. In some implementations, the association can be realized using drag-and-drop gesture (e.g., holding down the UD2 320 and moving the icon into the UD1 310). After the master and sub-group leader hierarchy has been established, the user may define how often the sub-group leader user devices report to the master leader user device. For example, the report frequency can be defined as every 30 seconds, every five minutes, or a suitable interval. In some implementations, the user interface can enable identifying the devices using names, for example, human readable names such as John. To establish the hierarchy, the sensor can implement a mechanism to indicate that it is the device being targeted. For example, the sensor can implement a pairing mechanism in which a button is depressed to indicate that it is the device in focus.

Figure 3C:
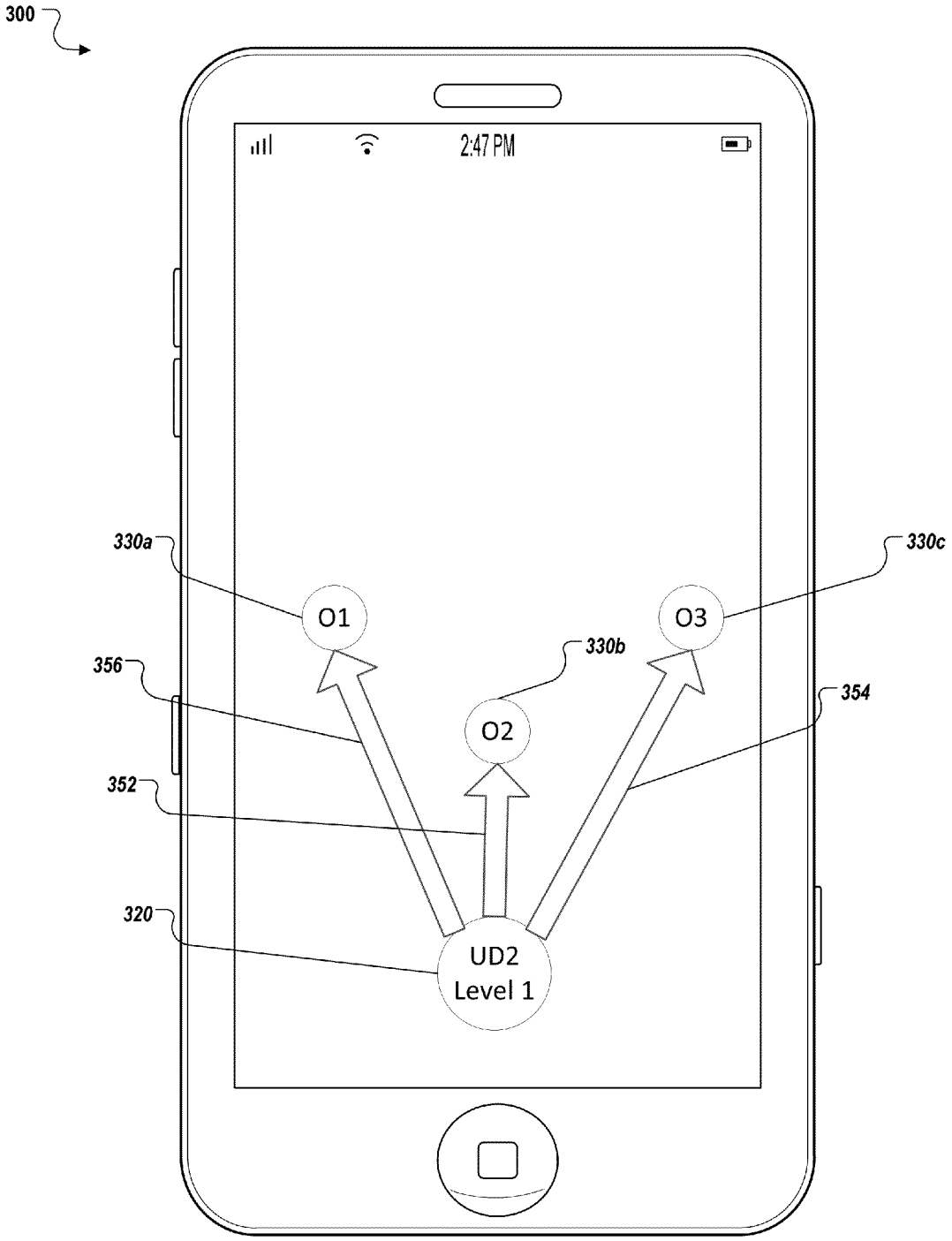
Figure 3D:
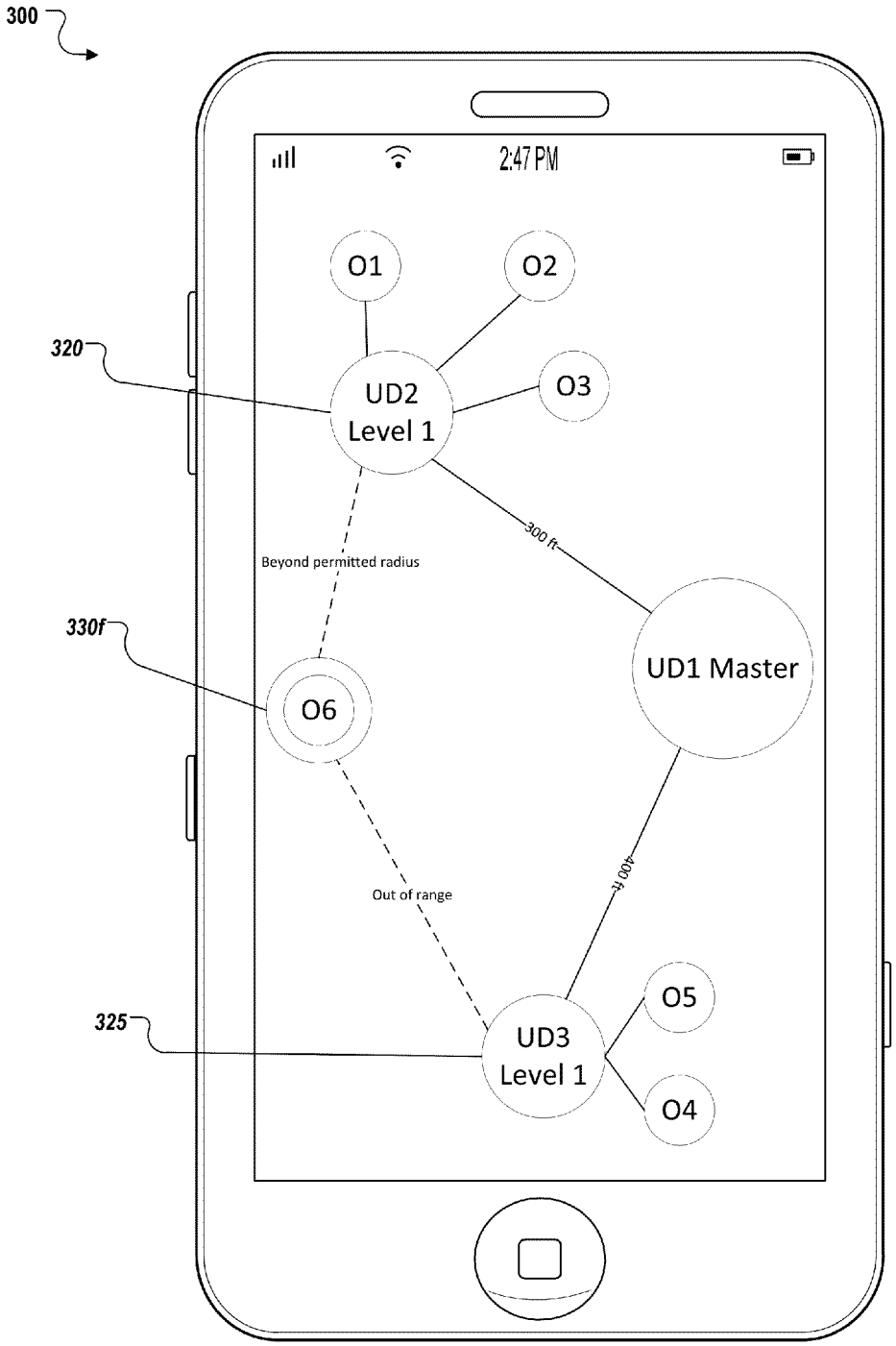

In FIG. 3C, observed units are assigned to one of the sub-group leaders defined in FIG. 3B. The assignment can enable the sub-group leader user device to actively monitor the associated observed units. For example, the observed units 330*a*, 330*b*, and 330*c* can be assigned to the sub-group leader 320 using similar multi-touch gesture for assigning sub-group leaders to master group leader. For example, a user may press and hold one of the observed devices and drag-and-drop them to the sub-group leader. As illustrated, observed units 330*a*, 330*b*, and 330*c* are assigned to the sub-group leader UD2 320. In some implementations, grouping assignments may be automatically performed or suggested based on distances and group size. For example, an automatic assignment may be performed when allowable minimum signal strength and maximum allowable group size are defined. The grouping assignment can thus be defined for all observed units: with observed units reporting to sub-group leaders (UD2 320 and UD3 325), and the sub-group leaders reporting to the master group leader, UD1 310. FIG. 3D further illustrates this relationship with an example scenario.

In FIG. 3D, comprehensive proximity information of the various group members is shown on the user device 300. The user device 300 is represented as the master group leader 310 in the GUI. In this example scenario, the master group leader UD1 310 is in communication with two sub-group leaders UD2 320 and UD3 325. Distances between the user devices may be calculated using location coordinates (e.g., provided by GPS receivers), or using other techniques. Each of the sub-group leaders 320 or 325 is monitoring a number of observed units. One observed unit O6 330*f*, carried by its associated group member, has gone out of the range of its assigned sub-group leader UD2 325. The out-of-range status may be detected when the signal strength of the observed unit O6 330*f* to the UD2 325 falls below a threshold value. An alarm message indicating the out-of-range situation may be sent to the user device 300 and in some cases to UD1 320. In some implementations, the alarm message may be triggered upon a determination that the observed unit goes beyond a permitted radius (e.g., the permitted radius is closer than the signal range). The permitted radius may be defined by priority, user selection, or other methods. The alarm message can further include direction information about the O6 330*f* that has triggered the warning, as described below. However, if the user device is untraceable, the distance may or may not be relevant. In such situations, distance or direction can be a rough estimate based on the last known location and direction of the user device.

Figure 3E:
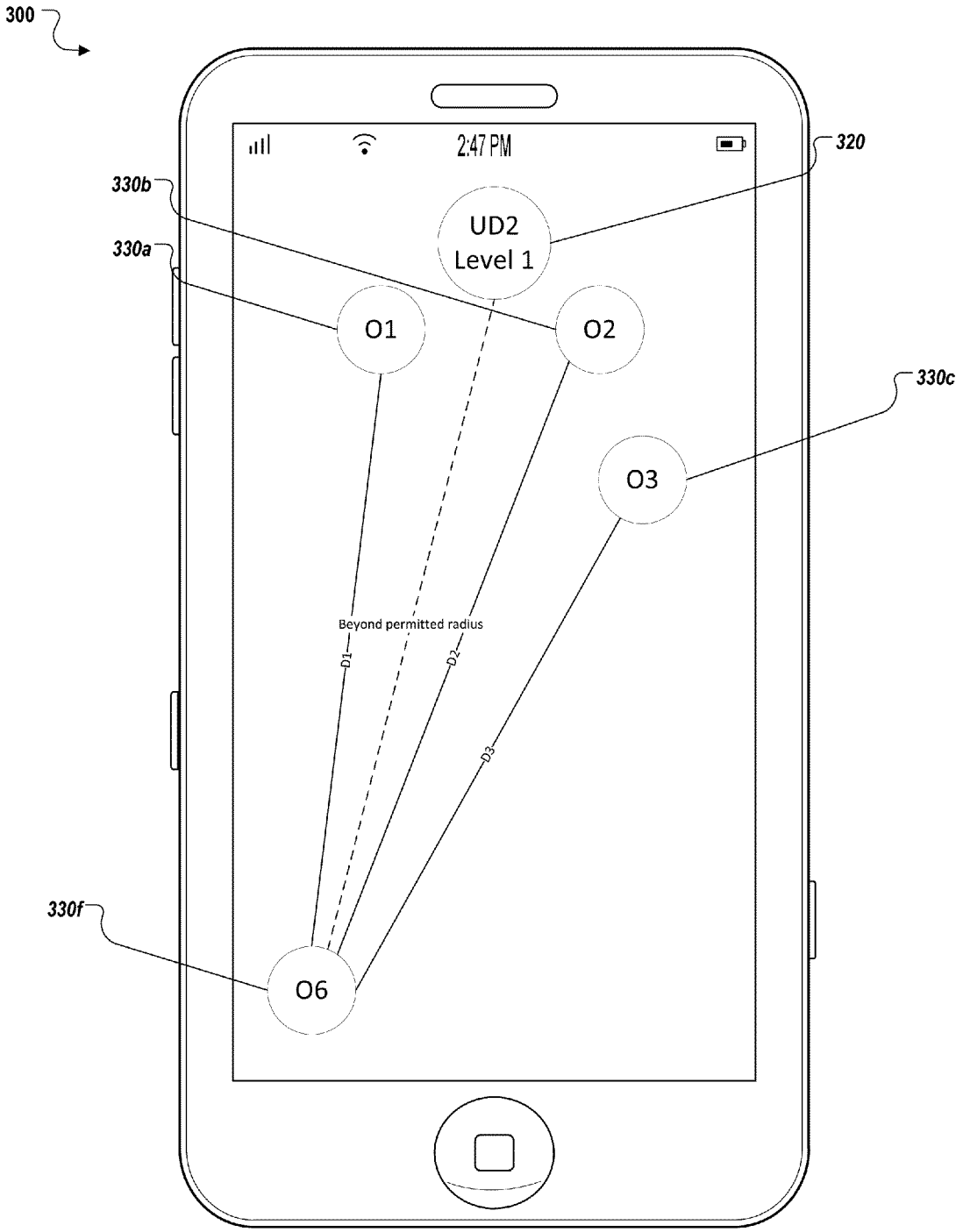
Figure 3F:
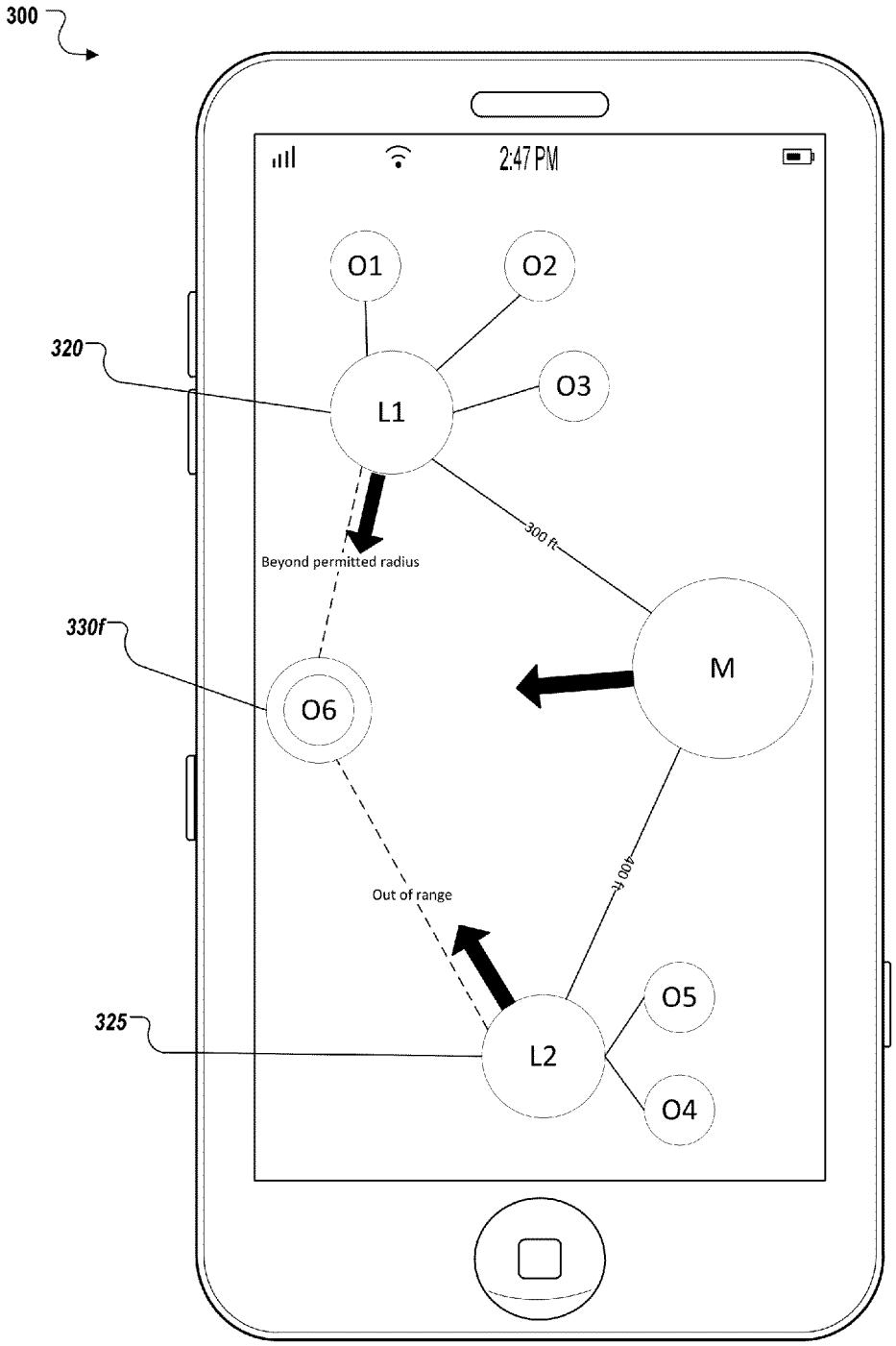

FIG. 3E illustrates an example method for identifying the direction of an observed unit that has gone out-of-range from a sub-group leader. Each observed unit may include a sensor that can detect signal strength and/or determine the distance from other observed units. When one observed unit (e.g., 330*f*) goes out of the range of a sub-group leader (e.g., 320), and when the observed unit is still within range of at least two other observed units (e.g., 330*a*, 330*b*, or 330*c*), the two other observed units can provide the direction information to the sub-group leader using signal triangulation or other suitable techniques. For example, when O6 330*f* is out of the range of the UD2 320, but is in range of the O1 330*a* and O2 330*b*, the direction from the most recently detected O6 330*f* can be calculated using the distances between O1 330*a* and O6 330*f*, O2 330*b* and O6 330*f*, UD2 320 and O1 330*a*, and UD2 320 and O2 330*b*. The calculated direction can then be shown in a comprehensive report as shown in FIG. 3F. Alternatively, information about last known distance between observed units and/or user devices can be used to infer a likely direction of travel of an observed unit that has gone out of range. Even if assignment of a device is one-to-one (i.e., one device to a parent), proximity can be ascertained at any given time using a gesture input, and pressing and holding the two nodes to gauge distance.

FIG. 3F shows a comprehensive report showing direction information of the O6 330*f*. The sub-group leaders can use this information to have O6 rejoin the group (e.g., by moving towards the direction). In some implementations, if the out-of-range observed unit is beyond a permitted radius of the originally assigned sub-group leader, but within the permitted radius of another sub-group leader, the master group leader may reassign the observed unit to the in-range sub-group leader. Such re-assignments may also be made selectively by the master group leader or by sub-group leaders at any time (e.g., when a group member wants to join a different group).

Figure 3G:
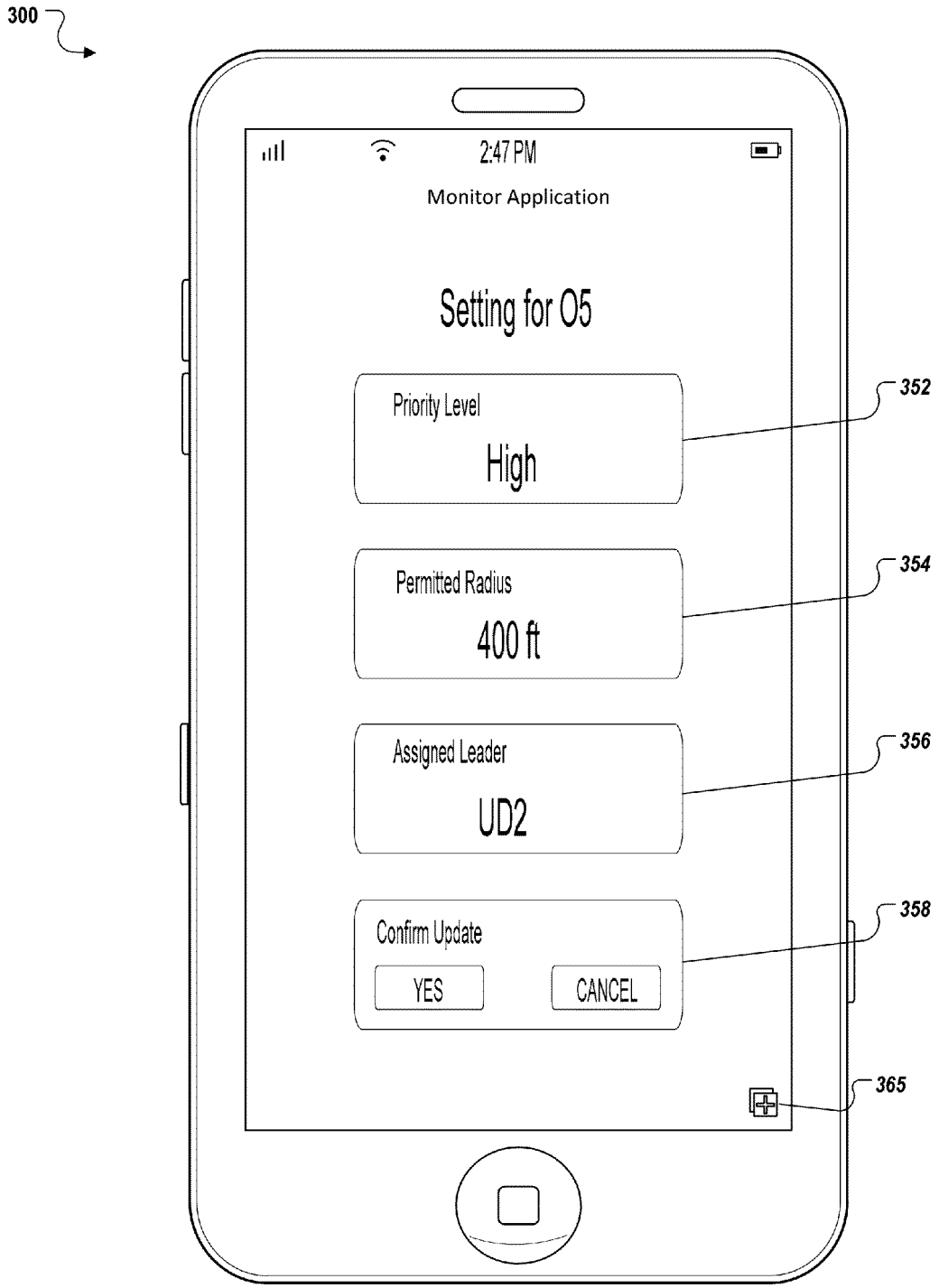

FIG. 3G illustrates parameter settings for each observed unit. The parameter setting may be opened by tapping or clicking on the icon of the observed unit. The parameter setting can include at least options for a priority level 352, a permitted radius 354, an assigned leader 356, and a confirmation window 358. The priority level 352 may be set as low, medium, or high. For example, a toddler may be assigned a higher priority level than a sixth-grader. The priority level may be by default associated with other parameters. For example, a high priority level may indicate a closer permitted radius and a more senior assigned leader. In some implementations, default settings may be automatically applied to the selected observed unit when the priority level is selected. The permitted radius 354 can be defined to send alarm messages when the corresponding observed device reaches a distance beyond the permitted radius. The assigned leader 356 may be chosen from available sub-group leaders in range of the observed unit. Availability may depend on the capacity of the sub-group leader and the number of observed units being monitored by the sub-group leader. The confirmation window 358 allows users to confirm the changes to the settings, or to exit without saving the changes. Options for defining additional parameters may be opened with an "add" button 365. In some implementations, the user interface can include metrics that describe temporal information for a user. For example, the metrics can include information that Node 354 (Alex) was traced 5 seconds ago. Such temporal metrics can be significant for missing users. Also, as described above, the names can be readable names for the person who wears the sensor.

Figure 4:
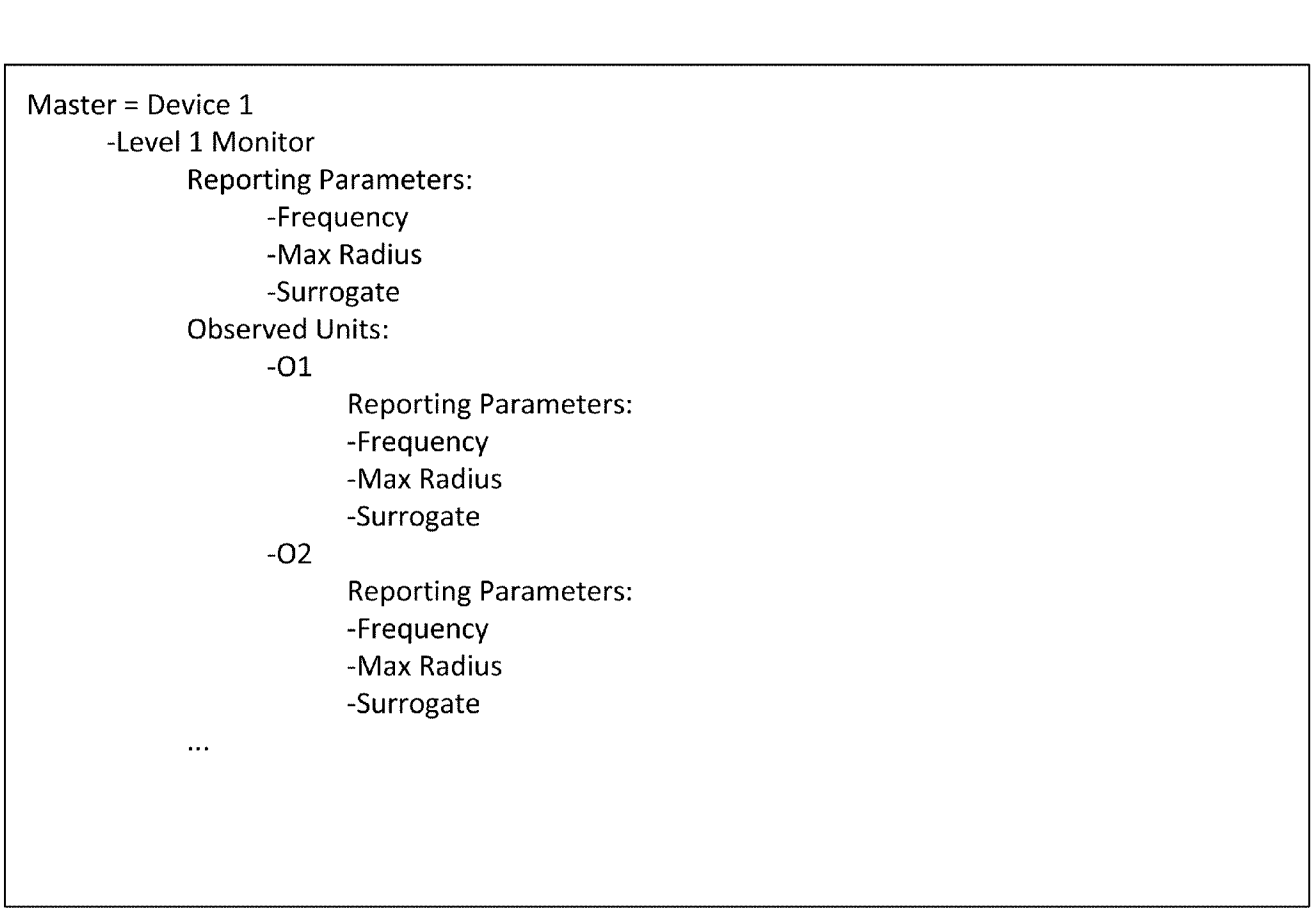
FIG. 4 is a hierarchy structure for assignment for tracking group members' proximity.

FIG. 4 is a hierarchy structure 400 for assignment for tracking group members' proximity. The hierarchy structure 400 may correspond to parameter data set in FIG. 3G. For example, the hierarchy structure 400 can be created when a monitor application is initiated and the master group leader user device is designated. At the top level, a master leader user device is defined (e.g., Device 1 in the shown example). The master leader user device can then be assigned with a first level 1 monitor, which can be a sub-group leader's user device. The sub-group leader's user device communicates with the master leader user device in accordance with reporting parameters defined by default or by the master group leader. The reporting parameters can include: reporting frequency, allowable maximum radius from the sub-group leader to the master group leader, reporting surrogate (e.g., another sub-group leader user device) if the sub-group leader moves out of range, battery life of sensors or devices (or both), to name a few. Although FIG. 4 illustrates one level 1 monitor, two or more level 1 monitors can be assigned by or to the master group leader user device. Each level 1 monitor can be associated with one or more observed units. The observed units may be any proximity sensor capable of sending signals to the level 1 monitor. Reporting parameters can be defined for each observed unit. The reporting parameters may include reporting frequency, allowable maximum radius from the observed unit to the sub-group leader, and reporting surrogate.

Figure 5:
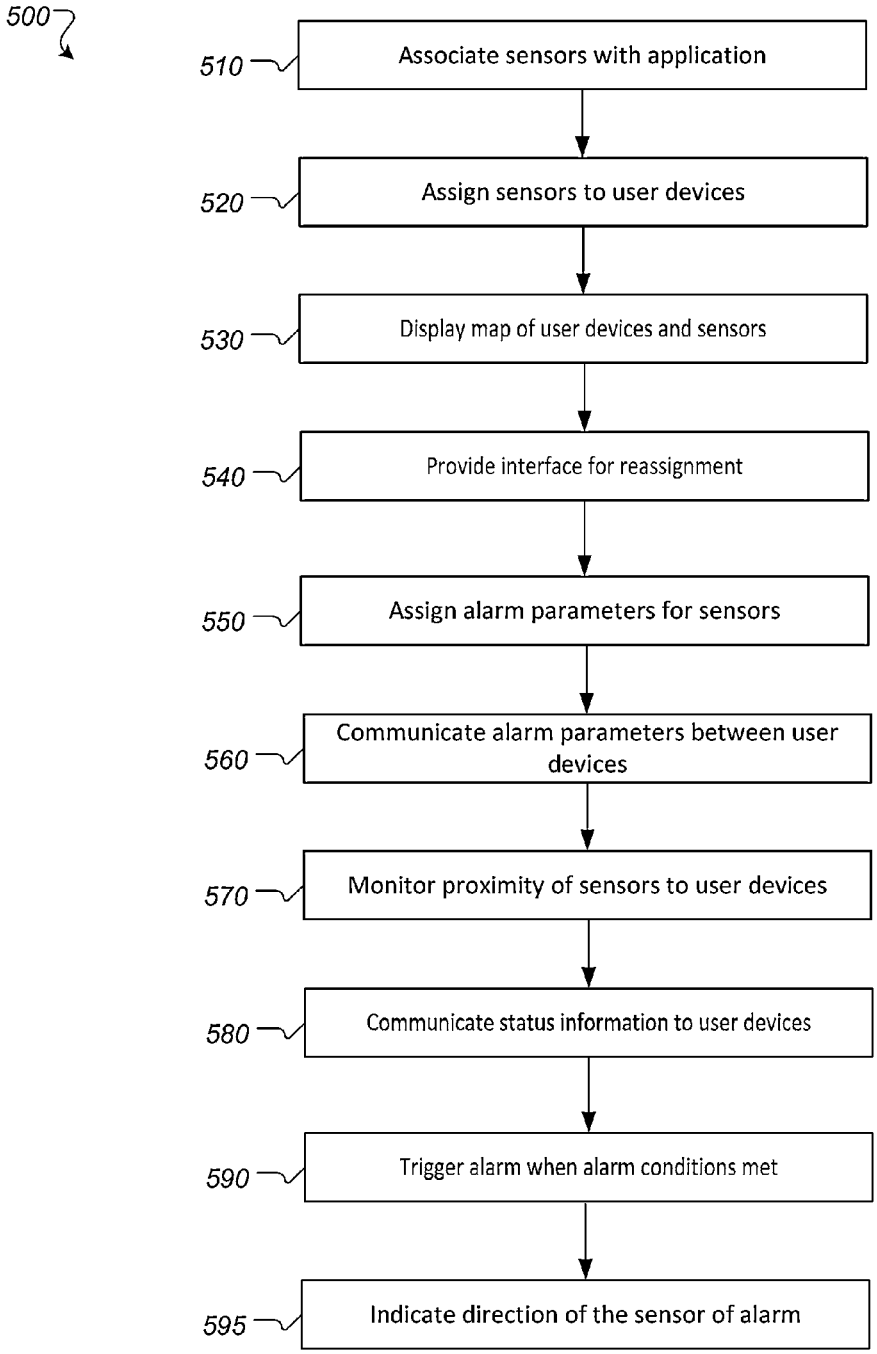
FIG. 5 is a flow diagram of a process for tracking group members' proximity.

FIG. 5 is a flow diagram 500 of a process for tracking group members' proximity. At 510, a number of sensors are associated with a monitor application. The sensors can be proximity sensors transmitting a signal or location information wirelessly. The monitor application can be installed on one or more user devices capable of receiving the signal or location information sent from the sensors. In some implementations, the user device can be a smart phone connected to a network using various technologies. Multiple user devices can be used in a system for tracking multiple group members' proximity. For example, a group can include a master group leader, one or more sub-group leaders, and a number of group members. The master group leader and sub-group leaders may each have a user device installed with the monitor application. The group members can each be attached with a sensor associable with the monitor application. For example, as illustrated in FIG. 3A, the monitor application can find in range sensors and display the search result to the master group leader and/or a sub-group leader.

At 520, the master group leader or a sub-group leader assigns the sensors to a corresponding one of the user devices (e.g., to a sub-group leader). The assignment may be automatic based on distances from the sensors to the user devices, or may be determined by user input. The sensors can communicate with the corresponding user device using a short range wireless communication link. The assignment process may include assigning one of the user devices as a master user device. The master user device can receive updates regarding proximity between a sensor and the corresponding user device or regarding sensor assignments. The updates are received from other user devices having corresponding assigned sensors. The updates can be used to facilitate providing group member status information to each of the various group leaders and coordinating monitoring of the group members.

At 530, the assigned sensors and user devices are displayed along with a map background. The map displays an approximate location of the user devices and the sensors. The display can allow the master group leader or the sub-group leader to monitor the locations of and distances between the connected sensors and user devices. In some implementations, the settings for the displayed sensors and user devices may be configured using the display interface (e.g., with a multi-touch screen).

At 540, in case a previous assignment of sensors is less optimal, the monitor application provides an interface for users to reassign the sensors to other user devices. For example, in an overview illustrated in FIG. 3D, a sub-group leader may drag and drop one of the sensors to another user device to indicate reassignment. In some implementations, the monitor application can provide a user interface on one of the number of user devices to enable a reassignment of a sensor from one user device to another different user device. After the reassignment, the different user device can monitor the proximity of the sensor.

At 550, detailed alarm parameters can be assigned to the user devices and sensors using the display interface. For example, a user may tap and hold an icon of the sensors or user devices to bring out a parameter setting window similar to the interface shown in FIG. 3G. In some implementations, the master group leader or the sub-group leader can define parameters for each assigned sensor, such as which group member is associated with the sensor, priority level, reporting frequency, and maximum allowable range. A set of default settings may be pre-programmed according to the priority level. For example, a high priority level may introduce parameters of a small maximum allowable range and a high reporting frequency. And a low priority level may introduce parameters of a large maximum allowable range and a low reporting frequency. When the assigned parameters are breached (e.g., sensors' value being greater than the allowable value), an alarm mechanism can be triggered on the user device of the assigned sub-group leader and/or on other user devices. The alarm mechanism may include sending a text message, causing a sound or vibration, or generating other actions that may catch the user's attention.

At 560, the set alarm parameters are communicated across the connected user devices (e.g., to synchronize parameter settings for all connected user devices). The synchronization communication allows alarm parameters to be propagated such that the master group leader user device can set correct parameters for sensors from sub-group leader user devices. In some implementations, the master group leader user device may override or change the parameters on the sub-group leader user devices. Different sub-group leader user devices may include different sets of alarm parameters associated with different sensors. For example, the alarm parameters associated with one sensor of a number of sensors can differ from the alarm parameters associated with another different sensor. In some implementations, different alarm parameters for different user devices but for the same sensor may result in triggering an escalation of alarms to other user devices. Similarly, different levels of alarms (e.g., a warning alarm and a critical alarm) can be used on a single user device.

At 570, the monitor application monitors proximity of each of the sensors to the corresponding user device. The monitor application can update, refresh, and/or sample data from sensors and user devices to determine if any sensor is no longer in compliance with the defined alarm parameters. For example, the monitor application can monitor if a sensor is moving out of a permitted radius by tracking the updating differences between actual sensor distance and the pre-defined maximum allowable radius. For example, a sensor is determined to be moving away from a user device if the distance between actual sensor and the pre-defined maximum allowable radius is decreasing with time. The signals received from the sensors can be used to update the monitor application about the proximity information at a user-defined frequency, e.g., every 5 seconds, 10 seconds, a minute, etc. The monitor application on different user devices may also communicate to update the proximity information at a user-defined interval, as further discussed below.

At 580, the monitor application communicates status information between two or more of the user devices. The status information indicates proximity of sensors to the corresponding user device and/or sensor assignments for one or more of the user devices. The communication between different user devices can enable both sub-group leaders and the master group leader to monitor connected sensors in a comprehensive manner, having an overall view of sub-groups and their associated sensors. For example, the communication can include status information related to an alarm condition to at least one other of the number of user devices. The alarm condition may include whether an alarm has been triggered, current distance information, sensor power information, triggered alarm history, and the associated time stamps therewith.

At 590, an alarm is triggered for a sensor. The alarm can be triggered when the corresponding alarm condition for the sensor is met, such as exceeding a pre-defined maximum allowable radius. The alarm may be triggered and communicated in a form of popping up messages, playing an audio or video clip, vibrating the user device, and forwarding the alarm to other user devices and/or monitor servers. In some implementations, an alarm is triggered as soon as an instance of signal update reflects that a pre-defined maximum allowable radius is exceeded. In some implementations, an alarm is triggered when the pre-defined maximum allowable radius has been exceeded for a pre-defined period of time. Other alarm settings are possible.

At 595, the direction of the alarmed sensor can be indicated on the user devices of the master group leader and/or sub-group leaders. For example, the direction of the sensor that triggered the alarm may be determined using signal triangulation as described in FIG. 3E. In some implementations, the sensors can include transceivers to communicate with each other for determining relative positions and distances. The distance or signal strength information can be sent to the sub-group leader user device to calculate a relative direction between a sensor and the user device. In some implementations, the current direction may be calculated for multiple connected user devices to inform sub-group leaders, and the master group leader. The indicated direction can help the master group leader and the sub-group leaders move towards the alarmed sensor for regaining communication signal.

Implementations of the present disclosure and all of the functional operations provided herein can be realized in digital electronic circuitry, or in computer software, firmware, or hardware, including the structures disclosed in this specification and their structural equivalents, or in combinations of one or more of them. Implementations of the invention can be realized as one or more computer program products, i.e., one or more modules of computer program instructions encoded on a computer readable medium for execution by, or to control the operation of, data processing apparatus. The computer readable medium can be a machine-readable storage device, a machine-readable storage substrate, a memory device, a composition of matter affecting a machine-readable propagated signal, or a combination of one or more of them. The term "data processing apparatus" encompasses all apparatus, devices, and machines for processing data, including by way of example a programmable processor, a computer, or multiple processors or computers. The apparatus can include, in addition to hardware, code that creates an execution environment for the computer program in question, e.g., code that constitutes processor firmware, a protocol stack, a database management system, an operating system, or a combination of one or more of them.

A computer program (also known as a program, software, software application, script, or code) can be written in any form of programming language, including compiled or interpreted languages, and it can be deployed in any form, including as a stand-alone program or as a module, component, subroutine, or other unit suitable for use in a computing environment. A computer program does not necessarily correspond to a file in a file system. A program can be stored in a portion of a file that holds other programs or data (e.g., one or more scripts stored in a markup language document), in a single file dedicated to the program in question, or in multiple coordinated files (e.g., files that store one or more modules, sub programs, or portions of code). A computer program can be deployed to be executed on one computer or on multiple computers that are located at one site or distributed across multiple sites and interconnected by a communication network.

The processes and logic flows described in this disclosure can be performed by one or more programmable processors executing one or more computer programs to perform functions by operating on input data and generating output. The processes and logic flows can also be performed by, and apparatus can also be implemented as, special purpose logic circuitry, e.g., an FPGA (field programmable gate array) or an ASIC (application specific integrated circuit).

Processors suitable for the execution of a computer program include, by way of example, both general and special purpose microprocessors, and any one or more processors of any kind of digital computer. Generally, a processor will receive instructions and data from a read only memory or a random access memory or both. The essential elements of a computer are a processor for performing instructions and one or more memory devices for storing instructions and data. Generally, a computer will also include, or be operatively coupled to receive data from or transfer data to, or both, one or more mass storage devices for storing data, e.g., magnetic, magneto optical disks, or optical disks. However, a computer need not have such devices. Moreover, a computer can be embedded in another device, e.g., a mobile telephone, a personal digital assistant (PDA), a mobile audio player, a Global Positioning System (GPS) receiver, to name just a few. Computer readable media suitable for storing computer program instructions and data include all forms of non-volatile memory, media and memory devices, including by way of example semiconductor memory devices, e.g., EPROM, EEPROM, and flash memory devices; magnetic disks, e.g., internal hard disks or removable disks; magneto optical disks; and CD ROM and DVD-ROM disks. The processor and the memory can be supplemented by, or incorporated in, special purpose logic circuitry.

To provide for interaction with a user, implementations of the invention can be implemented on a computer having a display device, e.g., a CRT (cathode ray tube) or LCD (liquid crystal display) monitor, for displaying information to the user and a keyboard and a pointing device, e.g., a mouse or a trackball, by which the user can provide input to the computer. Other kinds of devices can be used to provide for interaction with a user as well; for example, feedback provided to the user can be any form of sensory feedback, e.g., visual feedback, auditory feedback, or tactile feedback; and input from the user can be received in any form, including acoustic, speech, or tactile input.

Implementations of the present disclosure can be realized in a computing system that includes a back end component, e.g., as a data server, or that includes a middleware component, e.g., an application server, or that includes a front end component, e.g., a client computer having a graphical user interface or a Web browser through which a user can interact with an implementation of the present disclosure, or any combination of one or more such back end, middleware, or front end components. The components of the system can be interconnected by any form or medium of digital data communication, e.g., a communication network. Examples of communication networks include a local area network ("LAN") and a wide area network ("WAN"), e.g., the Internet.

The computing system can include clients and servers. A client and server are generally remote from each other and typically interact through a communication network. The relationship of client and server arises by virtue of computer programs running on the respective computers and having a client-server relationship to each other.

While this disclosure contains many specifics, these should not be construed as limitations on the scope of the disclosure or of what may be claimed, but rather as descriptions of features specific to particular implementations of the disclosure. Certain features that are described in this disclosure in the context of separate implementations can also be provided in combination in a single implementation. Conversely, various features that are described in the context of a single implementation can also be provided in multiple implementations separately or in any suitable sub-combination. Moreover, although features may be described above as acting in certain combinations and even initially claimed as such, one or more features from a claimed combination can in some cases be excised from the combination, and the claimed combination may be directed to a sub-combination or variation of a sub-combination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products.

Thus, particular implementations of the present disclosure have been described. Other implementations are within the scope of the following claims. For example, the actions recited in the claims can be performed in a different order and still achieve desirable results.

What is claimed is:

1. A method for tracking members of a group comprising:

associating a plurality of sensors with an application installed on each of a plurality of user devices;

establishing a hierarchy in the plurality of user devices and sensors, the hierarchy having at least a master level, a sub-group leader level, and a sensor level, wherein establishing the hierarchy comprises:

designating a first user device of the user device as a first sub-group leader device configured to receive signals from a first group of sensors associated with the first user device;

designating a second user device of the plurality of user devices as a second sub-group leader device configured to receive signals from a second group of sensors associated with the second user device;

designating a third user device of the plurality of user devices as a master user device configured to receive messages from one or more sub-group leader devices including the first user device and the second user device;

monitoring proximity of each of the sensors to a corresponding user device, including monitoring the first group of sensors by the first sub-group leader device, monitoring the second group of sensors by the second sub-group leader device, and monitoring the first sub-group leader device and the second sub-group leader device by the master device; and presenting an alarm on at least one of the user devices when a user device of the user devices determines that a sensor assigned to the user device is out of communication range of the user device or that a distance between the first device and the sensor assigned to the user device exceeds a pre-specified permitted radius, wherein presenting the alarm on at least one of the user devices comprises:

presenting an alarm on the master user device; and at least one of:

presenting an alarm on the first group leader device when the out-of-range or out-of-radius sensor is a sensor among the first group of sensors, or presenting an alarm on the second group leader device when the out-of-range or out-of-radius sensor is a sensor among the second group of sensors.

2. The method of claim 1 wherein:

the first user device submits updates on proximity between the sensor and the first user device, and relays the alarm to the master user device, and the master user device receives the updates and presents the alarm on the master user device.

3. The method of claim 2 further comprising displaying, on the master user device, a map of at least a respective approximate location of the first and second sub-group leader devices and a respective approximate location of each of the plurality of sensors, wherein an approximate location of a sub-group leader device is displayed using a different representation from a representation of an approximate location of a sensor.

4. The method of claim 2 further comprising assigning, by the master user device, a respective set of alarm parameters to be associated with each of the sensors, wherein assigning a set of alarm parameters to be associated with a sensor comprises:

displaying, on the master user device, an identifier of the sensor and user interface items configured to receive user input for specifying, for the sensor, a priority level, the permitted radius, and an identifier of a sub-group leader device to which the sensor is assigned; and assigning, to the sensor, the set of alarm parameters including the priority level, the permitted radius, and the sub-group leader device.

5. The method of claim 4 further comprising communicating the alarm parameters between the first and second user devices and then to each sensor.

6. The method of claim 4 wherein the alarm parameters associated with a first sensor of the plurality of sensors differ from the alarm parameters associated with a second sensor for the plurality of sensors, wherein a first sensor is assigned a first priority level and a first permitted radius, and a second sensor is assigned a second priority level and a second permitted radius.

7. The method of claim 4 further comprising triggering an alarm on a user device corresponding to a first sensor of the plurality of sensors based on an alarm condition satisfying the alarm parameters associated with the first sensor.

8. The method of claim 7 further comprising communicating status information regarding the alarm condition to at least one other of the plurality of user devices.

9. The method of claim 1 further comprising:

providing a user interface on one of the plurality of user devices that enables a reassignment of a first sensor from the first user device to the second user device; and monitoring a proximity of the first sensor to the second user device after the reassignment.

10. The method of claim 1 wherein the sensors communicate with the corresponding user device via a short range wireless communication link.

11. The method of claim 1 further comprising:

detecting a direction between one or more of the plurality of user devices and a first sensor of the plurality of sensors; and displaying an indication of the direction between the first user device and the first sensor on the first user device.

12. A non-transitory computer storage medium encoded with a computer program, the program comprising instructions that when executed by data processing apparatus cause the data processing apparatus to perform operations comprising:

associating a plurality of sensors with an application installed on each of a plurality of user devices;

designating a first user device of the user device as a first sub-group leader device configured to receive signals from a first group of sensors associated with the first user device;

designating a second user device of the plurality of user devices as a second sub-group leader device configured to receive signals from a second group of sensors associated with the second user device;

designating a third user device of the plurality of user devices as a master user device configured to receive messages from one or more sub-group leader devices including the first user device and the second user device;

monitoring proximity of each of the sensors to the corresponding user device, including monitoring the first group of sensors by the first sub-group leader device, monitoring the second group of sensors by the second sub-group leader device, and monitoring the first sub-group leader device and the second sub-group leader device by the master device; and presenting an alarm on at least one of the user devices when a user device of the user devices determines that a sensor assigned to the user device is out of communication range of the user device or that a distance between the user device and the sensor assigned to the first device exceeds a pre-specified permitted radius, wherein presenting the alarm on at least one of the user devices comprises:

presenting an alarm on the master user device; and at least one of:

presenting an alarm on the first group leader device when the out-of-range or out-of-radius sensor is a sensor among the first group of sensors, or presenting an alarm on the second group leader device when the out-of-range or out-of-radius sensor is a sensor among the second group of sensors.

13. The computer storage medium of claim 12 wherein:

the first user device submits updates on proximity between the sensor and the first user device, and relays the alarm to the master user device, and the master user device receives the updates and presents the alarm on the second user device.

14. The computer storage medium of claim 13 wherein the operations comprises displaying, on the master user device, a map of at least a respective approximate location of the first and second user devices and a respective approximate location of each of the corresponding sensors, wherein an approximate location of a sub-group leader device is displayed using a different representation from a representation of an approximate location of a sensor.

15. The computer storage medium of claim 12 wherein the operations comprise receiving through a user interface an assignment of alarm parameters associated with the plurality of sensors.

16. The computer storage medium of claim 12 wherein the operations comprise:

receiving an indication of an alarm condition from the first or second user device, the alarm condition including at least one of whether an alarm has been triggered, current distance information, sensor power information, triggered alarm history, and associated time stamps therewith; and displaying information relating to the alarm condition.

17. The computer storage medium of claim 12, the operations comprising:

receiving location information for a first sensor of the plurality of sensors; and displaying at least an approximate direction toward the first sensor.

18. A system comprising:

a plurality of sensors;

a plurality of user devices adapted to communicate wirelessly with the plurality of sensors, wherein each user device includes software instructions adapted, when executed by processing apparatus on the user device, to perform operations comprising:

assigning each of the sensors to a corresponding one of the user devices, wherein assignments received on one of the user devices are wirelessly communicated to at least one other of the user devices;

designating a first user device of the user device as a first sub-group leader device configured to receive signals from a first group of sensors associated with the first user device;

designating a second user device of the plurality of user devices as a second sub-group leader device configured to receive signals from a second group of sensors associated with the second user device;

designating a third user device of the plurality of user devices as a master user device configured to receive messages from one or more sub-group leader devices including the first user device and the second user device;

monitoring proximity of each of the sensors to the corresponding user device, including monitoring the first group of sensors by the first sub-group leader device, monitoring the second group of sensors by the second sub-group leader device, and monitoring the first sub-group leader device and the second sub-group leader device by the master device;

and presenting an alarm on at least one of the user devices when a user device of the user devices determines that a sensor assigned to the user device is out of communication range of the user device or that a distance between the first user device and the sensor assigned to the first user device exceeds a pre-specified permitted radius, wherein presenting the alarm on at least one of the user devices comprises:

presenting an alarm on the master user device; and at least one of:

presenting an alarm on the first group leader device when the out-of-range or out-of-radius sensor is a sensor among the first group of sensors, or presenting an alarm on the second group leader device when the out-of-range or out-of-radius sensor is a sensor among the second group of sensors.

19. The system of claim 18 wherein the sensors communicate with the user devices using a short range wireless transmission, and the distance is determined by the first user device based on signal strength of the short range wireless transmission to the first user device from the sensor assigned to the first user device.

20. The system of claim 18, wherein:

the first user device submits updates on proximity between the sensor and the first user device, and relays the alarm to the master user device, and the master user device receives the updates and presents the alarm on the master user device.

21. The system of claim 18, wherein the master user device assigns a respective set of alarm parameters to be associated with each sensor, including:

displaying, in a user interface of the master user device, an identifier of the sensor and user interface items configured to receive user input for specifying, for the sensor, a priority level, the permitted radius, and an identifier of a sub-group leader device to which the sensor is assigned;

assigning, to the sensor, the set of alarm parameters including the priority level, the permitted radius, and the first or second sub-group leader device; and communicating the alarm parameters to the first or second sub-group leader device corresponding to the sensor.

22. The system of claim 18 wherein software instructions on at least a master user device are adapted, when executed by processing apparatus on the user device, to display status information associated with each of the user devices having corresponding sensor assignments.

23. The system of claim 18, the operations comprising, upon presenting the alarm, accessing an emergency service by a user device of the user devices using contact information stored on the user device.

24. The system of claim 23, wherein accessing the emergency service including dialing an emergency telephone number.

25. A method for tracking members of a group comprising:

associating a plurality of sensors with an application installed on each of a plurality of user devices;

assigning each of the sensors to a corresponding one of the user devices, wherein assignments received on one of the user devices are wirelessly communicated to at least one other of the user devices;

designating a first user device of the user devices as a sub-group leader device leading a group of sensors assigned to the first user device;

designating a second user device of the user devices as a master user device leading one or more sub-group leader devices including the first user device;

monitoring proximity of each of the sensors to the corresponding user device;

communicating status information between two or more of the user devices, wherein the status information indicates at least one of proximity of sensors to the corresponding user device or sensor assignments;

presenting an alarm on at least one of the user devices when the first user device determines that a sensor assigned to the first user device is out of communication range of the first user device or that a distance between the first user device and the sensor assigned to the first user device exceeds a pre-specified permitted radius, wherein:

the first user device submits, to the second user device, updates on proximity between the sensor and the first user device, presents the alarm on the first user device, and relays the alarm to the master user device, the master user device receives the updates and presents the alarm on the master user device; and displaying, on the master user device, a map of at least a respective approximate location of each of the sub-group leader devices and a respective approximate location of each of the plurality of sensors, wherein an approximate location of a sub-group leader device is displayed using a different representation from a representation of an approximate location of a sensor.

26. A method for tracking members of a group comprising:

associating a plurality of sensors with an application installed on each of a plurality of user devices;

assigning each of the sensors to a corresponding one of the user devices, wherein assignments received on one of the user devices are wirelessly communicated to at least one other of the user devices;

designating a first user device of the user devices as a sub-group leader device leading a group of sensors assigned to the first user device;

designating a second user device of the user devices as a master user device leading one or more sub-group leader devices including the first user device;

assigning, by the master user device, a respective set of alarm parameters to be associated with each of the sensors, wherein assigning a set of alarm parameters to be associated with a sensor comprises:

displaying, on the master user device, an identifier of the sensor and user interface items configured to receive user input for specifying, for the sensor, a priority level, a permitted radius, and an identifier of a sub-group leader device to which the sensor is assigned; and assigning, to the sensor, the set of alarm parameters including the priority level, the permitted radius, and the sub-group leader device;

monitoring proximity of each of the sensors to the corresponding user device;

communicating status information between two or more of the user devices, wherein the status information indicates at least one of proximity of sensors to the corresponding user device or sensor assignments; and presenting an alarm on at least one of the user devices when the first user device determines that a sensor assigned to the first user device is out of communication range of the first user device or that a distance between the first user device and the sensor assigned to the first user device exceeds a pre-specified permitted radius, wherein:

the first user device submits, to the second user device, updates on proximity between the sensor and the first user device, presents the alarm on the first user device, and relays the alarm to the master user device, the master user device receives the updates and presents the alarm on the master user device.

* * * * *